United States Patent [19]

Hudson

[11] 4,246,867

[45] Jan. 27, 1981

[54] XEROGRAPHIC DEVELOPING SYSTEM ROLLS HAVING MAGNETS OF DIFFERENT WIDTHS

[75] Inventor: Frederick W. Hudson, West Henrietta, N.Y.

[73] Assignee: Xerox Corporation, Stamford, Conn.

[21] Appl. No.: 510,939

[22] Filed: Oct. 1, 1974

Related U.S. Application Data

[63] Continuation of Ser. No. 354,598, Apr. 26, 1973, abandoned.

[51] Int. Cl.[3] ..... G03G 15/09

[52] U.S. Cl. ..... 118/655; 118/658

[58] Field of Search ..... 118/DIG. 24, 637, 623, 118/657, 658; 117/17.5; 355/3 DD; 346/74 ES; 101/DIG. 13; 198/41; 209/223; 427/14, 18

[56] References Cited

U.S. PATENT DOCUMENTS

| | | | |
|---|---|---|---|
| 1,956,291 | 4/1934 | Jessop | 198/41 |
| 2,873,843 | 2/1959 | Wilson | 198/41 |
| 3,040,704 | 6/1962 | Bliss | 118/658 |
| 3,098,765 | 7/1963 | Keller et al. | 118/637 |
| 3,167,171 | 1/1965 | Harmon et al. | 198/41 |
| 3,233,587 | 2/1966 | Morton | 118/637 |
| 3,362,380 | 1/1968 | Anderson et al. | 118/637 X |
| 3,557,751 | 1/1971 | Kushima et al. | 118/637 |
| 3,581,873 | 6/1971 | Spodig | 198/41 |
| 3,608,522 | 9/1971 | Davidson | 118/637 |
| 3,631,962 | 1/1972 | Mason et al. | 198/41 |
| 3,641,969 | 2/1972 | Hakanson | 118/637 X |
| 3,641,980 | 2/1972 | Bickmore | 118/637 |
| 3,648,656 | 3/1972 | Ogawa | 118/637 |
| 3,654,902 | 4/1972 | Hakanson | 118/658 |
| 3,707,947 | 1/1973 | Reichart, Jr. | 118/637 |
| 3,724,422 | 4/1973 | Latone et al. | 118/637 |
| 3,731,782 | 5/1973 | Del Rosso | 198/41 |
| 3,754,526 | 8/1973 | Caudill | 118/637 |

OTHER PUBLICATIONS

*IBM Technical Disclosure Bulletin,* "Magnetic Brush Unit with Magnetic Conveyor", Freeman et al., vol. 15, No. 4, (Sep. 1972), pp. 1251, 1252.

*Primary Examiner*—Evan K. Lawrence

[57] ABSTRACT

A xerographic developing system has rotating rolls in which stationary magnets of different axial widths are located. Magnetic developer is attracted to these rolls and the developer band width is controlled by the width of the magnets. The rolls may be transport rolls or developer rolls. When this concept is employed for transport rolls, a much larger sump capacity may be utilized since the developer band width can be controlled by varying the sizes of the magnets to keep the developer at the outer edges of the developer sump moving inwards to the developer zone. When this concept is employed for developer rolls, compensation is provided for spreading of the developer band and thereby loss of developer when the developer band is transported from one development roll in a magnetic brush system to another development roll either directly or by an intermediary transport roller.

19 Claims, 4 Drawing Figures

FIG. 1
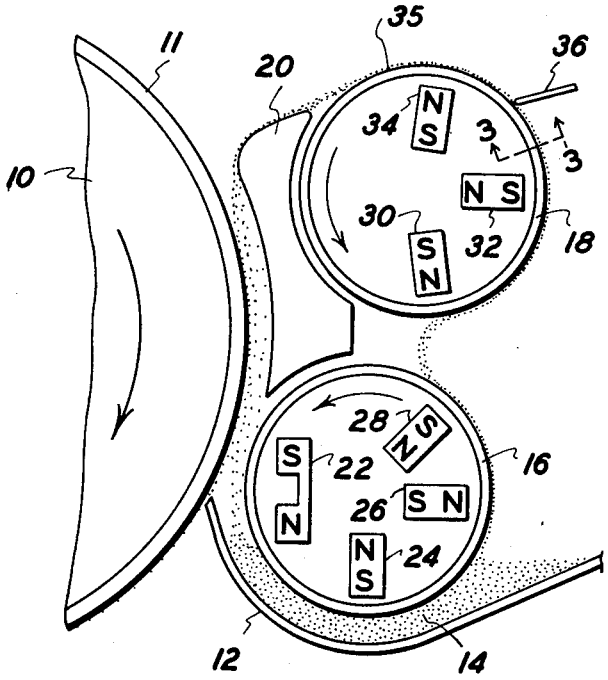
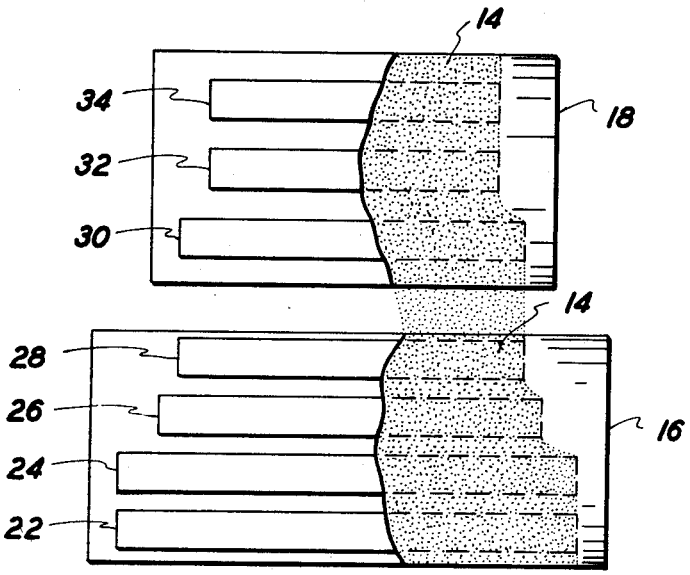
FIG. 2

FIG. 3
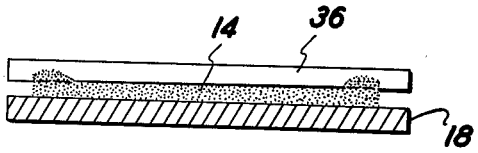
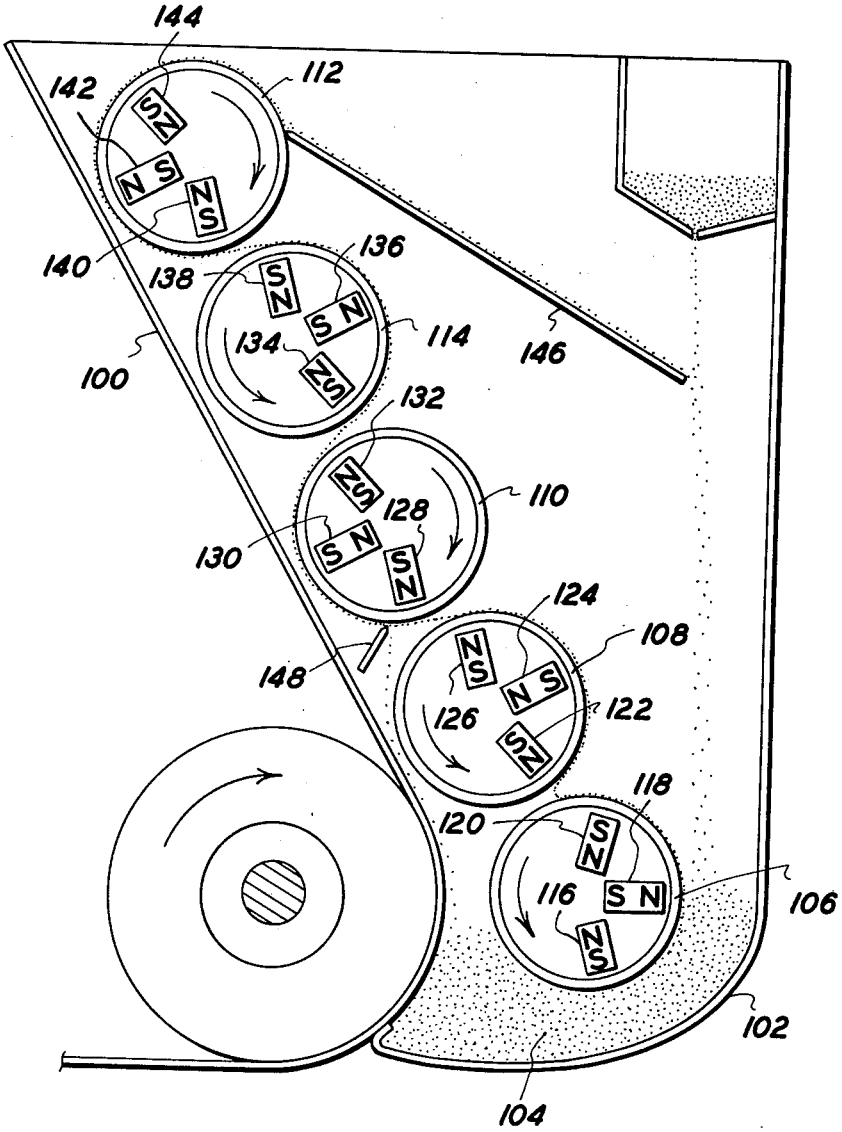
FIG. 4

XEROGRAPHIC DEVELOPING SYSTEM ROLLS HAVING MAGNETS OF DIFFERENT WIDTHS

This is a continuation of application Ser. No. 354,598, filed 4/26/73 and now abandoned.

This invention relates to magnetic developer transport systems and magnetic brush development systems.

More specifically, this invention relates to a magnetic developer transport system which controls the developer band width during transport thereof.

One application of the invention is for magnetic developer transport systems for a cascade development system.

Another application of the invention is for a magnetic transport system for a magnetic brush developer system.

Still another application of the invention is for a transport assembly which transports developer from one magnetic brush developer roll to another magnetic brush developer roll.

It is usually desirable to have as much developer capacity as possible in a developer sump since the more capacity that a sump has, the less frequent that a copying machine must be serviced to replace old developer with new developer.

It is an object of this invention to provide a developer transport system which will permit the use of large capacity developer sumps.

A problem with a magnetic brush development system has been spreading of a toner band on the magnetic brush when the developer is passed between a nip formed by the magnetic brush and a photoreceptive surface and also between the nip of a magnetic brush and a transport roll in a multi-roll developer brush system whereby some of the developer is forced out of the development zone and is therefore no longer available for developing an image during that cycle.

It is another object of this invention to provide a multi-magnetic developer roll system with means which will allow for spreading of a developer band on a magnetic developer roll and on an intermediate transport roll and yet retain all of the developer and transport the same at a proper width to another magnetic developer brush so that all of the developer may be used for developing an image during that cycle.

Other objects of this invention will become apparent from the following description with reference to the drawings wherein:

FIG. 1 is a schematic view of a xerographic copying system illustrating in particular a magnetic roll transport system;

FIG. 2 is a view of the transport system of FIG. 1 flattened out to illustrate a developer transport path and the relative width of magnet members in the transport system;

FIG. 3 is a view along section line 3–3 of FIG. 1; and

FIG. 4 is a view of a schematic brush developer system in which the concept of the invention is incorporated.

This invention relates to well-known xerographic copier systems. Such systems utilize a photoconductive drum or belt having arranged around it an imaging station, a developing station, a transfer station, a fusing station, and a cleaning station, all of which are well-known to those skilled in the art.

Referring to FIG. 1, there is illustrated a development station which comprises a drum 10, having a photoconductive surface 11 thereon, a developer sump 12 having developer particles 14 therein, a pair of rotatable cylindrical transport rolls 16 and 18, and a development electrode 20. The term "developer" as used in this specification and in the claims refer to either xerographic carrier particles having ferromagnetic properties mixed with xerographic toner particles or xerographic toner particles per se having ferromagnetic properties. Located within the transport roll 16 are a plurality of stationary circumferentially arranged permanent magnets 22, 24, 26 and 28 which are fixed to the developer housing.

Located within the transport roll 18 are stationary circumferentially arranged permanent magnets 30, 32 and 34. These permanent magnets are in the form of bars which extend generally parallel to the axis about which its respective transport roll rotates.

Referring to FIG. 2, the rolls 16 and 18 are depicted in a flattened out position to illustrate the developer band width during transport thereof. The rolls have also been partially cut away to show the relative lengths of the permanent magnets surrounded thereby. It can be seen that magnets 22 and 24 are the longest and are the same length, magnet 26 is shorter, magnets 28 and 30 are the same length but shorter than magnet 26 and magnets 32 and 34 are the same length but shorter than magnets 28 and 30 and correspond to the development zone width. The magnets are positioned in such a manner and are of such a strength relative to each other that the developer particles will form a width corresponding to substantially the length of the magnet when the toner particles are transported by their respective roller to a position adjacent to the particular magnet. This means that toner particles on transport roller 16 which are adjacent to the magnet 22 will have a band width equal to the length of the magnet 22 and as the roller carries that band into the field of magnet 24 the band will remain the same width. When the roller 16 carries the same developer band within the field of magnet 26 the band width will narrow to the length of magnet 26 and then as the band is transported within the field of magnet 28 the band width will narrow to the length of the magnet 28. As the band is transported across the magnet 28 into the field of magnet 30, the band of toner particles will be attracted to the roller 18 from the roller 16 where the toner particles assume a band width on the roller 18 equivalent to the length of the magnet 30 which is the same length as magnet 28. Thereafter the roller 18 transports the same toner band to the field of magnet 32 wherein the toner band width narrows to the length of magnet 32 and thereafter the toner particle layer is carried within the field of magnet 34 and remains the same width since magnet 34 is the same length as magnet 32. The transport roller 18 continues to rotate the band of developer out of the field of magnet 34 to a release point 35 whereby the developer is no longer held onto the roll 18 by the magnet 34 and then falls by centrifugal force and gravity into the space between the electrode 20 and the photoreceptor 10 whereby the developer will cascade over the photoconductor surface 11 to develop an electrostatic latent image thereon.

Magnet 22 is positioned in such a manner that it will attract the residual magnetic developer to the roll 16 thereby acting as a pickoff magnet. Magnet 24 is positioned to attract additional developer to the roll 16 from the developer sump while the remaining magnets are positioned for transporting the developer to the release point 35.

As the developer band decreases, the layer of toner at the edges of the band builds up to a thickness greater than the layer between the edges as shown in FIG. 3. A scraper blade 36 is positioned adjacent the roller 18 in such a manner to scrape off the excess developer from the edges whereby a uniform layer is carried to the release point 35. The edge layer which is scraped off by the scraper 36 falls back into the developer sump at a position which corresponds axially with the ends of the magnets 34. From this it can be seen that developer which was picked up in an axial position which corresponds with the ends of the magnets 22 and 24 has now been moved inwardly to an axial position which corresponds with the development zone width. Thus, this system keeps developer moving from the axial ends of the sump housing to a position where it can be utilized in image development.

In cascade development, it is known that developer is dumped onto the photoconductive surface over a width that corresponds to the development zone but as the developer cascades downwards over the photoconductive surface, the developer width expands beyond the width of the development zone thus requiring a sump which is wider than the development zone. The developer which is located in the end of the housing, which corresponds to a dimension beyond the width of the development zone, must be mixed and kept moving into the development zone in order that the maximum capacity of the sump or developer sump is utilized. It follows that with the system of this invention, it is possible to construct developer sumps which are much wider than development zones since one can construct and design the magnets to be of such lengths and strengths to narrow the developer band to the width of the development zone at the release point. With this additional developer sump capacity, a copier may be operated for a much longer period of time without having to replenish developer.

Referring to FIG. 4, there is illustrated a magnetic brush development system comprising a photoconductor belt 100, a developer sump 102 containing magnetic developer particles 104 therein, transport rolls 106 and 108, a first development roll 110 and an upper development roll 112, and a transport roll 114 which is located between the development rolls. Located within the transport roll 106 are permanent magnet bars 116, 118 and 120. Located within the transport roll 108 are permanent magnet bars 122, 124, and 126 and located within the developer roll 110 are stationary permanent magnet bars 128, 130 and 132. Stationary permanent magnet bars 134, 136 and 138 are located within the transport roll 114 and stationary permanent magnet bars 140, 142 and 144 are located within the developer roll 112. A scraper member 146 is located adjacent the developer roll 112 and a scraper member 148 is located adjacent the developer roll 110 to scrape off excess developer on the respective rolls and direct the same back to the sump 102. The transport rolls 106 and 108 operate in the same manner as the rolls 16 and 18 in the embodiment of FIG. 1. The magnet 116 is positioned to attract developer from the sump to the surface of the roll 106 and is of a length which is greater than the width of the development zone. Magnets 120, 122, 124 and 126 are progressively shorter than magnet 16 to narrow the developer band attracted to the roll 106 by the magnet 116 to a width equal to the development zone which is the width of magnet bar 126. The developer band is transferred to the magnetic brush as it comes within the field of the magnet 128 and since the band has already been reduced to the development zone width, the magnets 128 and 130 may be of equal length.

As described previously, developer builds up at the ends of the developer band as it becomes narrowed and therefore the scraper 148 is utilized to scrape off the excess developer at the edges of the developer band which falls back into the developer sump.

When developer passes through a nip between two rolls such as between the photoconductor 100 and developer roll 110, the developer roll 110 and transport roll 114, and the transport roll 114 and the development roll 112, the developer band widens whereby developer is forced either out of the development zone or off the ends of the developer rolls. In order to compensate for and prevent this from happening, the magnets 132 and 134 may be longer than the development zone width to keep the developer on the rolls. Magnets 136 and 138 may be decreasingly shorter in length than magnet 134 so when the developer band is passed through the nip between the transport roll 114 and the developer roll 112 the developer band will spread to the width of the developer zone thus retaining all the developer for presentation by the developer roll 112 to the latent image.

If transport roll 114 is utilized as a developer roll instead of a transport roll, the width of the magnets of each roll could be adjusted to compensate for widening of the developer band as the band passes through the nip between the photoconductor 100 and the respective developer roll to avoid developer loss and thus retain all the developer for presentation to the latent image.

In summary, it can be seen that in accordance with the principles of this invention, the developer band width can be controlled by varying the sizes of the magnets to keep the developer at the outer edges of the developer sump moving inwards to the developer zone. It can also be utilized to compensate for spreading of the developer band and thereby loss of developer when the developer band is transported from one development roll in a magnetic brush system to another development roll either directly or by an intermediary transport roller.

It is obvious that the concept of this invention may be applied to continuous webs rather than the transport or developer rollers described.

It should be understood that to carry out the principles of the invention the magnets can be designed to be any length and adjacent magnets may either vary in length or be the same length depending on the results desired and the space available to obtain such results. The main criteria is to design the magnets in such a manner to shape the developer band width in accordance with desired results.

What is claimed is:

1. In a developer system: developer having ferromagnetic properties, at least two endless rotatable members having said developer said members about a respective axis, first magnetic means for attracting developer from one of said rotatable members and holding the same on the other of said rotatable members, second magnetic means for attracting and holding said developer on said one rotatable member until the developer is rotated within the field of said first magnetic means, said first magnetic means including at least one permanent stationary magnet member extending in a generally axial direction surrounded by said other rotatable member, said second magnetic means including at least one per- FIG. 3
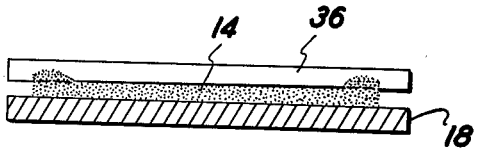
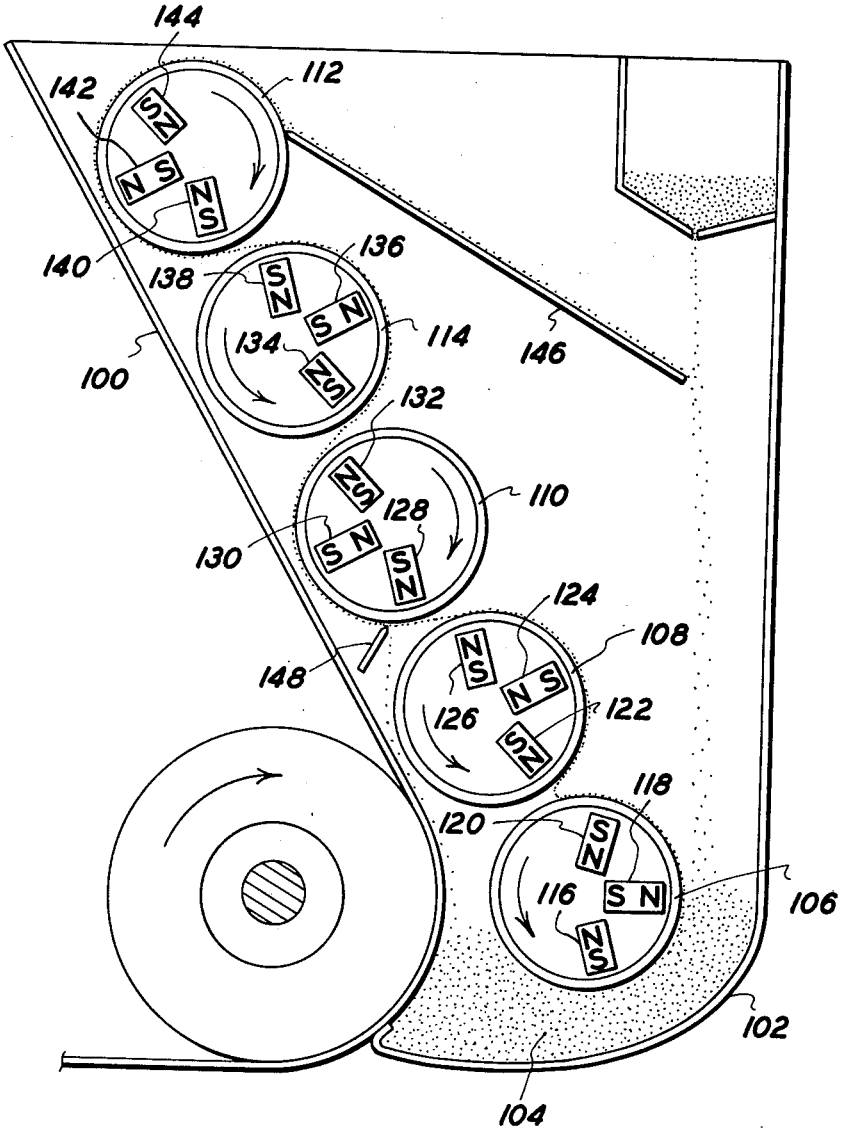
FIG. 4

UNITED STATES PATENT AND TRADEMARK OFFICE

CERTIFICATE OF CORRECTION

PATENT NO. : 4,246,867

DATED : January 27, 1981

INVENTOR(S) : Frederick W. Hudson

It is certified that error appears in the above-identified patent and that said Letters Patent are hereby corrected as shown below:

Claim 1, third line, between "developer" and "said", add —thereon, means for rotating—.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*